US007818819B2

(12) United States Patent
Chiang

(10) Patent No.: US 7,818,819 B2
(45) Date of Patent: Oct. 26, 2010

(54) DUAL-PURPOSE NECK GAITER

(75) Inventor: Tsung-Pai Chiang, Taipei (TW)

(73) Assignee: Sound Team Enterprise Co., Ltd., Taipei (TW)

( * ) Notice: Subject to any disclaimer, the term of this patent is extended or adjusted under 35 U.S.C. 154(b) by 85 days.

(21) Appl. No.: 12/285,262

(22) Filed: Oct. 1, 2008

(65) Prior Publication Data

US 2009/0276938 A1 Nov. 12, 2009

(30) Foreign Application Priority Data

May 8, 2008 (TW) ..... 97117060 A

(51) Int. Cl.
*A42B 3/00* (2006.01)

(52) U.S. Cl. ..... 2/206; 2/174

(58) Field of Classification Search ..... 2/206, 2/468, 269, 202, 207, 174; 24/578.1, 574.1, 24/11 M, 70 J, 68 J, 578.16, 578.11, 300, 24/464, 465, 664, DIG. 51, DIG. 60
See application file for complete search history.

(56) References Cited

U.S. PATENT DOCUMENTS

| | | | | |
|---|---|---|---|---|
| 3,237,210 | A * | 3/1966 | Graber | 2/209.11 |
| 5,007,115 | A * | 4/1991 | Denbow et al. | 2/208 |
| 5,309,574 | A * | 5/1994 | Balaban et al. | 2/202 |
| 5,822,800 | A * | 10/1998 | Anderson | 2/202 |
| 7,082,652 | B2 * | 8/2006 | St-Louis et al. | 24/715.4 |
| 2010/0064417 | A1 * | 3/2010 | Fruge | 2/202 |

* cited by examiner

*Primary Examiner*—Gary L Welch
*Assistant Examiner*—Alissa J Tompkins
(74) *Attorney, Agent, or Firm*—Bacon & Thomas, PLLC

(57) ABSTRACT

A dual-purpose neck gaiter includes a hollow cylindrical gaiter body that has two insertion holes near one of two openings thereof, and an elastic cord member inserted through the insertion holes of the hollow cylindrical gaiter body for tying up one end of the hollow cylindrical gaiter body for enabling the dual-purpose neck gaiter to be used as a beanie. A first connector and a second connector may be respectively provided at the two ends of the elastic cord member for detachably joining the ends of the elastic cord member together.

11 Claims, 11 Drawing Sheets

DUAL-PURPOSE NECK GAITER

This application claims the priority benefit of Taiwan patent application number 097117060 filed on May 8, 2008.

BACKGROUND OF THE INVENTION

1. Field of the Invention

The present invention relates to a neck gaiter and more particularly, to a dual-purpose neck gaiter, which has a simple structure and is comfortable and easy to use and, which is provided with a binder for tying up one end of the gaiter body so that the neck gaiter can be used as a beanie for covering the user's head.

2. Description of the Related Art

During the cold season, people may wear winter coat, scarf, hat, gloves, muff, etc. to keep the body, the head, the neck and the hands warm. Nowadays, many young people give in to the urge for fashion. They may wear a round neck or V-neck top and then wear a scarf about the neck to keep the neck warm during a cold day. However, cold wind may get into gaps in the scarf, causing the wearer to feel uncomfortable. Further, to keep the neck and the head warm, a hat and a scarf shall be used. Preparing these two articles cost a lot. Further, it is inconvenient to carry these two articles together. To eliminate this problem, a dual-purpose neck gaiter that can be alternatively used as a beanie is thus created.

FIGS. 10 and 11 show a conventional dual-purpose neck gaiter. According to this design, the dual-purpose neck gaiter A has a sleeve A11 extending around a top open end A1, a binding cord B inserted through the sleeve A11, and a cord lock C fastened to the binding cord B. When unlocked, the cord lock C can be moved relative to the binding cord B to have the top open end A1 of the dual-purpose neck gaiter A be opened or tied up for enabling the dual-purpose neck gaiter A to be used as a neck warmer, a beanie and a face mask.

The aforesaid dual-purpose neck gaiter A still has drawbacks as follows:

1. During fabrication of the dual-purpose neck gaiter A, one end of the dual-purpose neck gaiter A must be processed to provide a sleeve A11 for the insertion of a binding cord B. The formation of the sleeve A11 complicates the fabrication of the dual-purpose neck gaiter A, thereby increasing the manufacturing cost.

2. When the cord lock C is locked after the binding cord B has been pulled tight to close the top open end A1 of the dual-purpose neck gaiter A, a major part of the binding cord B suspends outside the dual-purpose neck gaiter A. The suspending binding cord B may be tangled with the user's hair accidentally, causing injury.

SUMMARY OF THE INVENTION

The present invention has been accomplished under the circumstances in view. It is one object of the present invention to provide a dual-purpose neck gaiter, which is easy and inexpensive to manufacture and comfortable to use for keeping the neck warm.

It is another object of the present invention to provide a dual-purpose neck gaiter, which can be arranged into the form of a beanie to keep the head warm.

To achieve these and other objects of the present invention, the dual-purpose neck gaiter comprises a hollow cylindrical gaiter body that has two insertion holes near one of two openings thereof, and an elastic cord member inserted through the insertion holes of the hollow cylindrical gaiter body for tying up one end of the hollow cylindrical gaiter body for enabling the dual-purpose neck gaiter to be used as a beanie.

Further, a first connector and a second connector may be respectively provided at the two ends of the elastic cord member for detachably joining the ends of the elastic cord member together.

DETAILED DESCRIPTION OF THE PREFERRED EMBODIMENT

Figure 1:
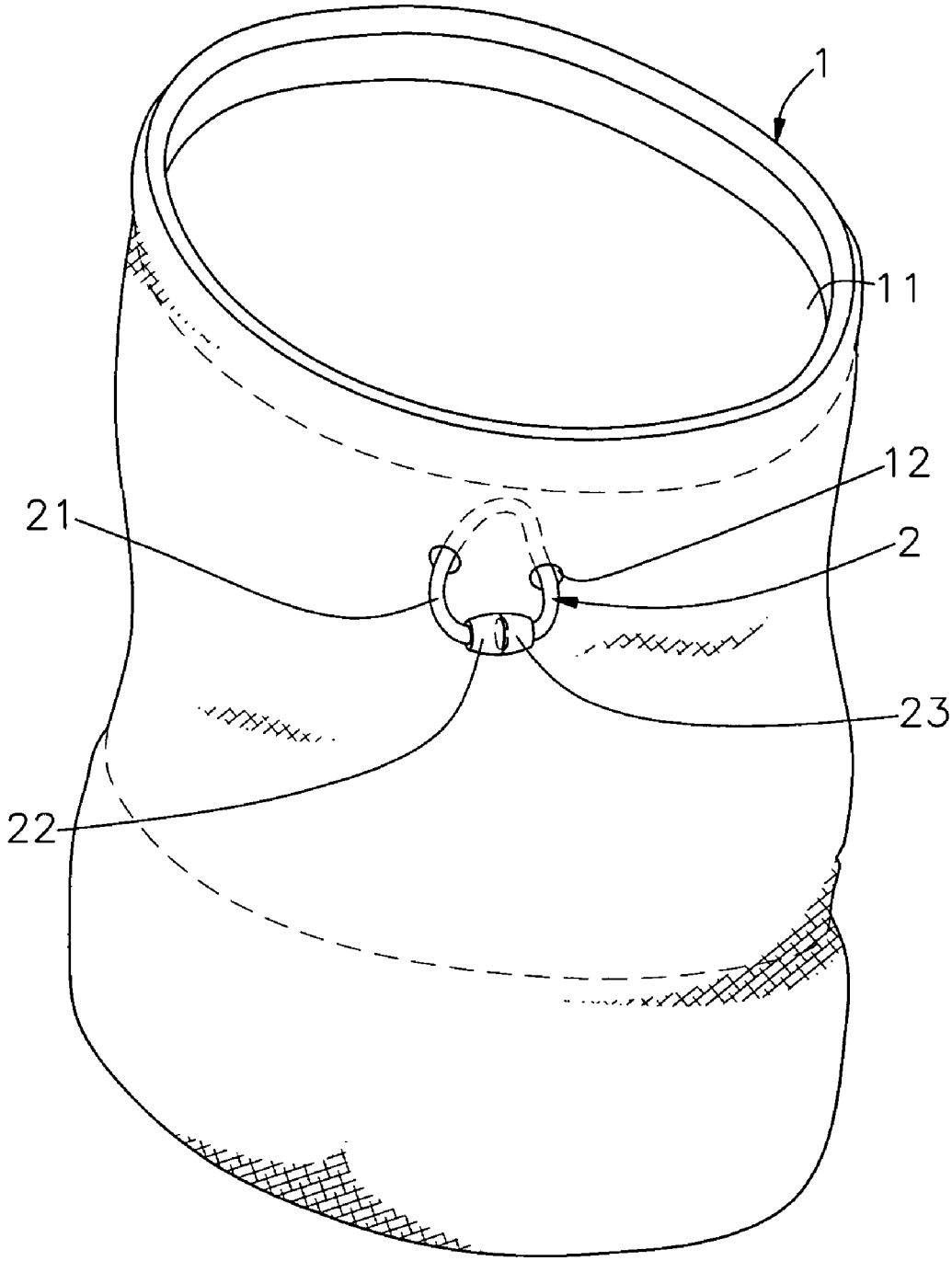
FIG. 1 is a schematic perspective view of a dual-purpose neck gaiter in accordance with the present invention.
Figure 2:
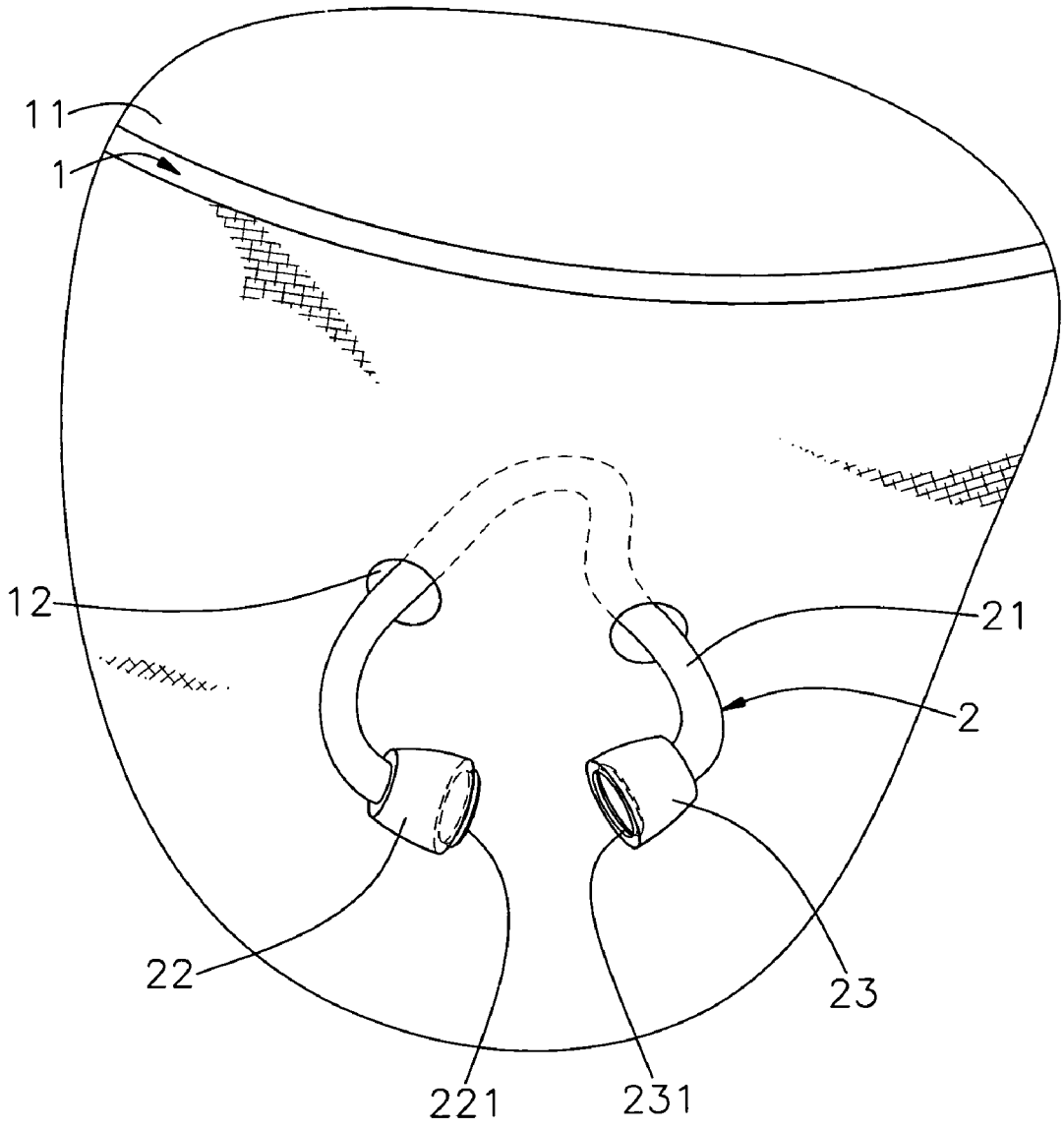
FIG. 2 is a schematic view in an enlarged scale of a part of the dual-purpose neck gaiter in accordance with the present invention.
Figure 3:
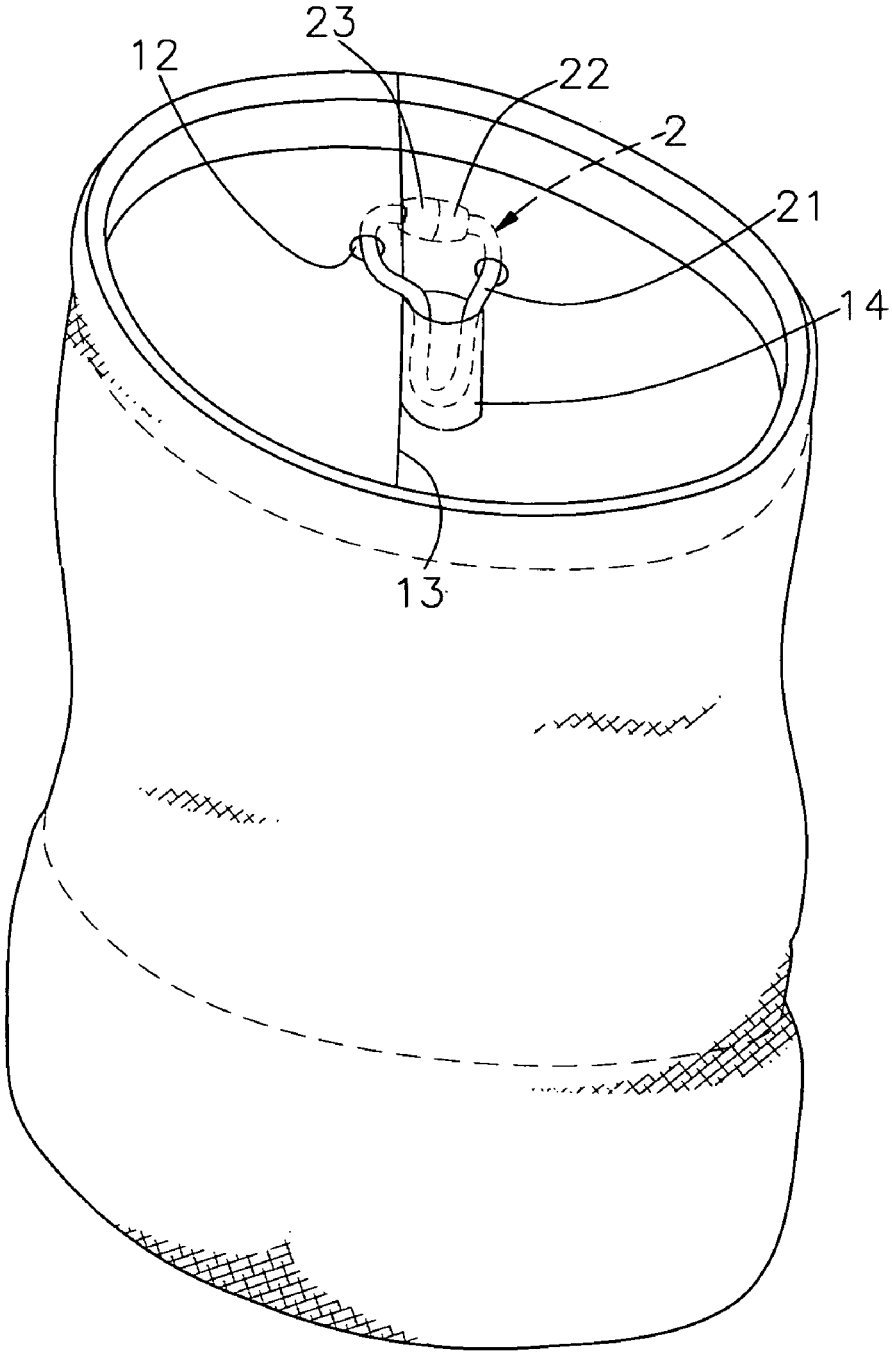
FIG. 3 is schematic perspective view of the dual-purpose neck gaiter in accordance with the present invention when viewed from another angle.

Referring to FIGS. 1~3, a dual-purpose neck gaiter in accordance with the present invention is shown comprising a gaiter body 1 and a binder 2.

The gaiter body 1 is a hollow cylindrical member preferably prepared from a warm-keeping fabric with excellent air permeability, having two insertion holes 12 cut through the periphery near one of the two opposite openings 11.

The binder 2 comprises an elastic cord member 21 inserted through the two insertion holes 12 of the gaiter body 1, a first connector 22 fastened to one end of the elastic cord member 21 and suspending outside the gaiter body 1, and a second connector 23 fastened to the other end of the elastic cord member 21 and suspending outside the gaiter body 1 and connectable to the first connector 22. The first connector 22 and the second connector 23 have a size greater than the diameter of the insertion holes 12 so that the first connector 22 and the second connector 23 are not movable through the insertion holes 12. The elastic cord member 21 can be made of an elastic-plastic material or rubber.

During installation, the elastic cord member 21 of the binder 2 is inserted through the insertion holes 12, and then the first connector 22 and the second connector 23 are respectively fastened to the two distal ends of the elastic cord member 21 and suspending outside the gaiter body 1, and then the first connector 22 and the second connector 23 are connected together. When assembled, the part of the elastic cord member 21 that suspends inside the gaiter body 1 is received in a fabric label 14 that is stitched with its two distal ends to a line of stitches 13 of the gaiter body 1.

According to the embodiment shown in FIG. 3, the line of stitches 13 that extends longitudinally through the two distal ends of the gaiter body 1 is invisible from the outside of the gaiter body 1 and can be seen from the inside of the gaiter body 1.

Figure 4:
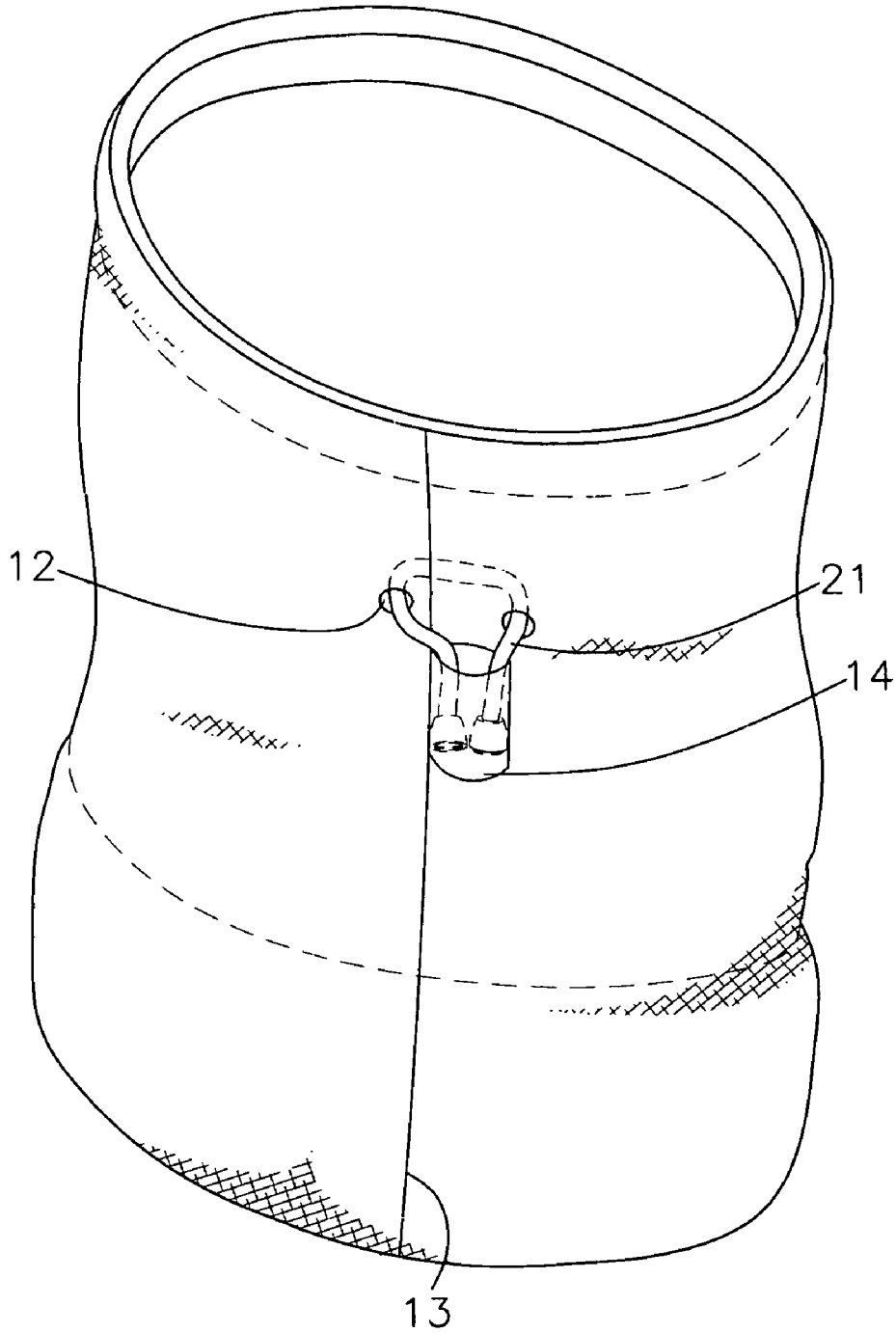
FIG. 4 is schematic perspective view of an alternate form of the dual-purpose neck gaiter in accordance with the present invention.

FIG. 4 shows an alternate form of the dual-purpose neck gaiter. According to this alternate form, the line of stitches 13 is visible from the outside of the gaiter body 1 and invisible from the inside of the gaiter body 1; the fabric label 14 is stitched with its two distal ends to the line of stitches 13 and suspending outside the gaiter body 1; the first connector 22 and the second connector 23 are suspending outside the gaiter body 1 and receivable inside the fabric label 14.

The aforesaid first connector 22 and second connector 23 can be molded from plastics, and detachably connectable to each other. According to the embodiment shown in FIG. 2, the first connector 22 is a male connector having a stud 221, and the second connector 23 is a female connector having a socket 231 adapted for receiving the stud 221 of the first connector 22. By means of the elastic material property, the first connector 22 and the second connector 23 are fastened together upon insertion of the stud 221 into the socket 231.

Figure 5:
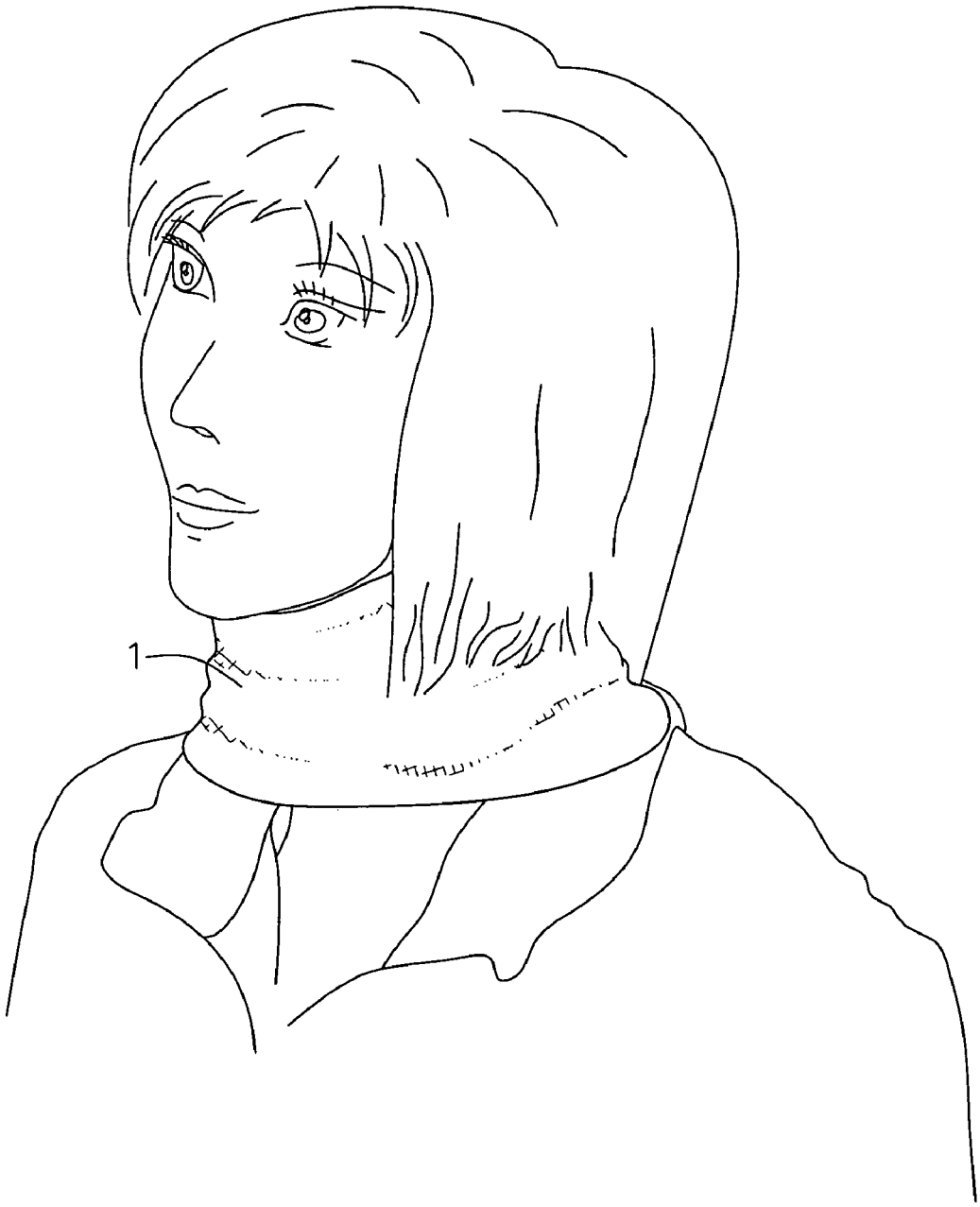
FIG. 5 shows one application example of the dual-purpose neck gaiter according to the present invention.

The dual-purpose neck gaiter can be used for different applications. According to the application example shown in FIG. 5, the dual-purpose neck gaiter is sleeved onto a person's neck and arranged in a folded manner to keep the neck warm. In this case, the elastic cord member 21, the first connector 22 and the second connector 23 are concealed inside a folded part of the gaiter body 1 and kept away from direct contact with the skin of the user's neck. Therefore, the elastic cord member 21 will not be stretched accidentally, and the binder 2 is prohibited from hooking the user's clothing or any other external object.

Figure 6:
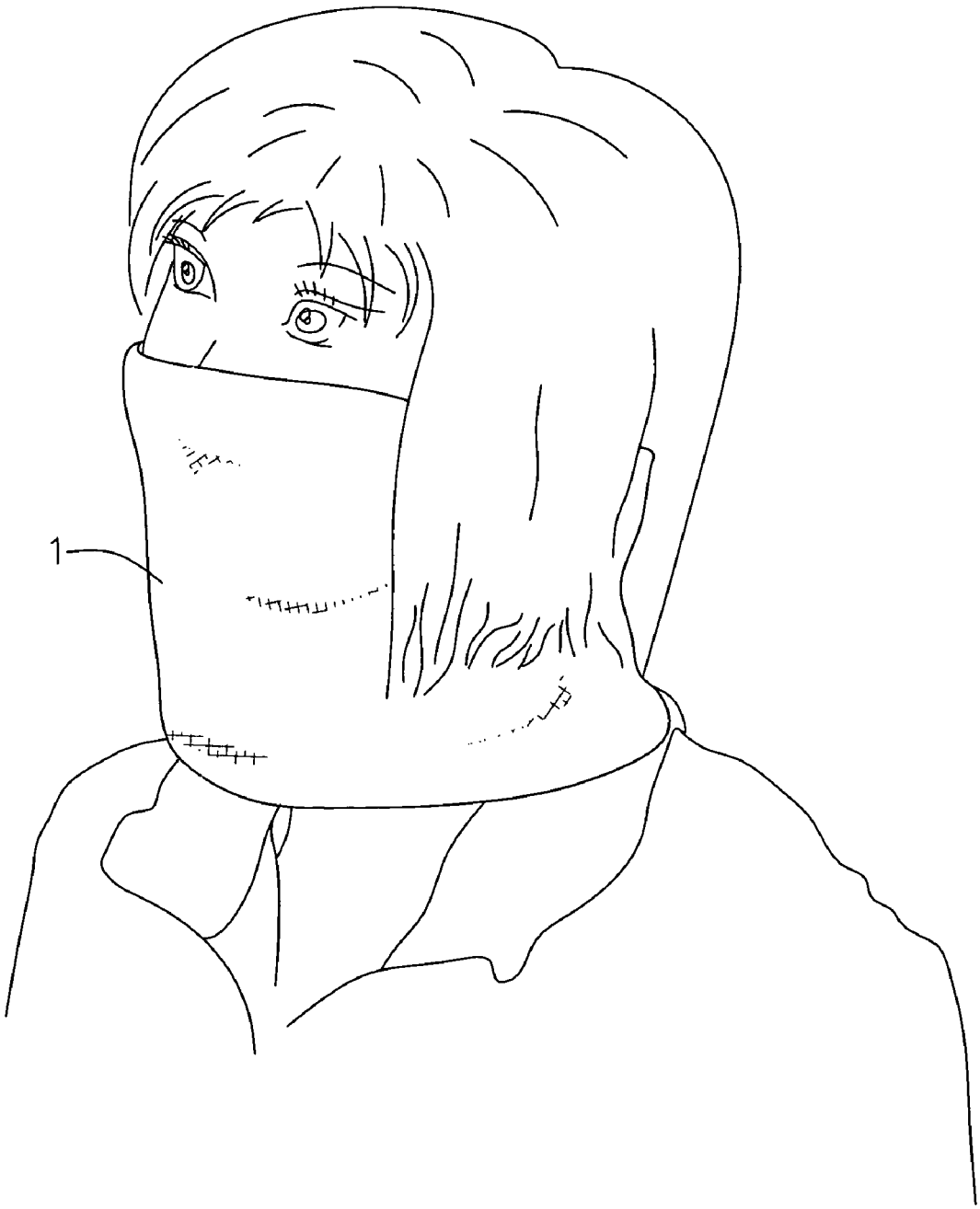
FIG. 6 shows another application example of the dual-purpose neck gaiter according to the present invention.

According to the application example shown in FIG. 6, the dual-purpose neck gaiter is sleeved onto the user's neck and lower part of the head as a face mask to keep the user's neck, mouth and nose warm.

Figure 7:
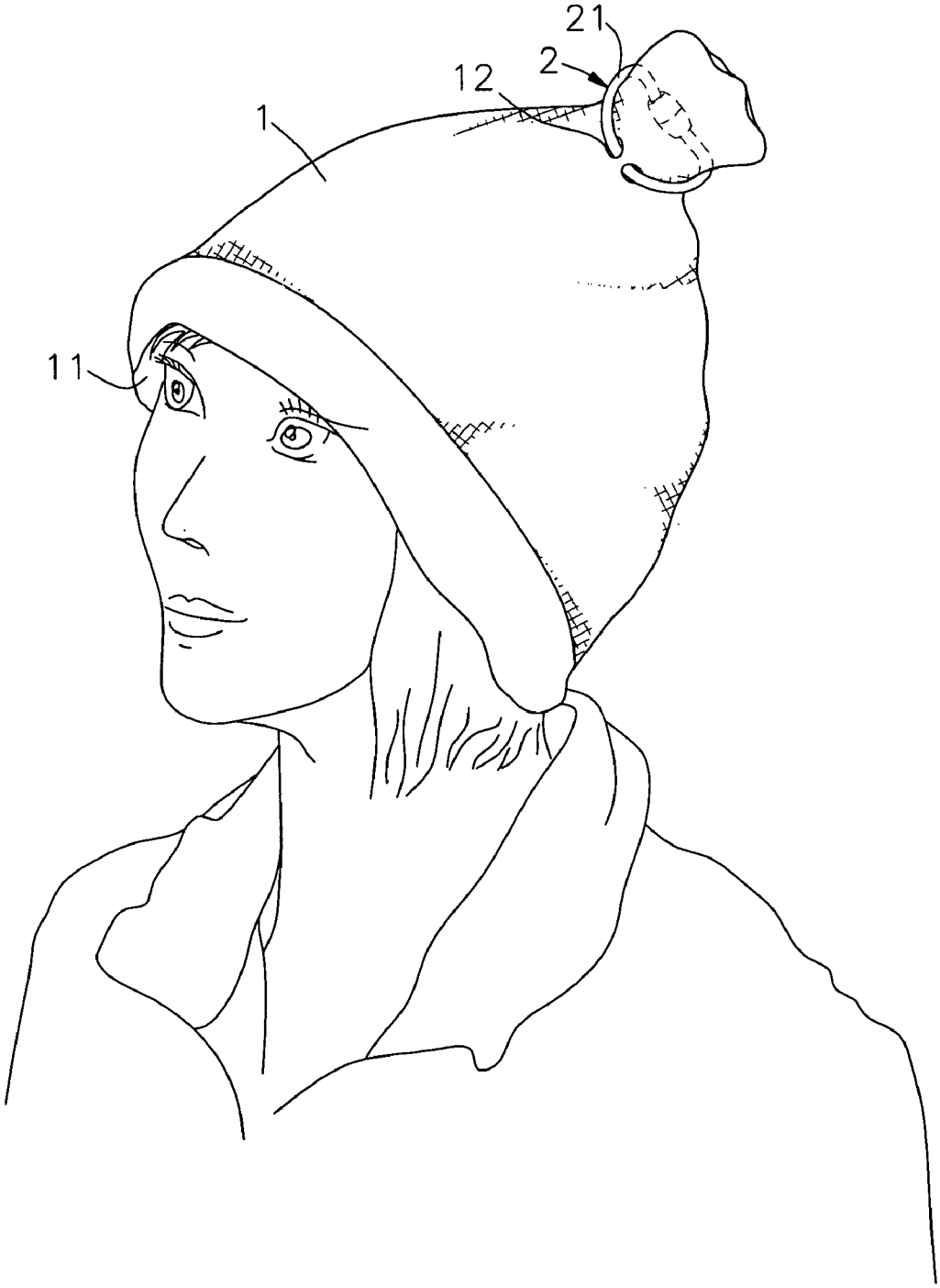
FIG. 7 shows still another application example of the dual-purpose neck gaiter according to the present invention.

According to the application example shown in FIG. 7, the dual-purpose neck gaiter is used as a beanie. In this case, the first connector 22 and the second connector 23 are disconnected from each other, and then the elastic cord member 21 is wound round one end of the gaiter body 1, and then the first connector 22 and the second connector 23 are fastened together to tie up one of the two openings 11 of the gaiter body 1 so that the dual-purpose neck gaiter shows the shape of a beanie and the wrapped end of the gaiter body 1 forms a crown. By means of the other opening 11 of the gaiter body 1, the gaiter body 1 can be put on the user's head conveniently to keep the user's head warm.

Figure 8:
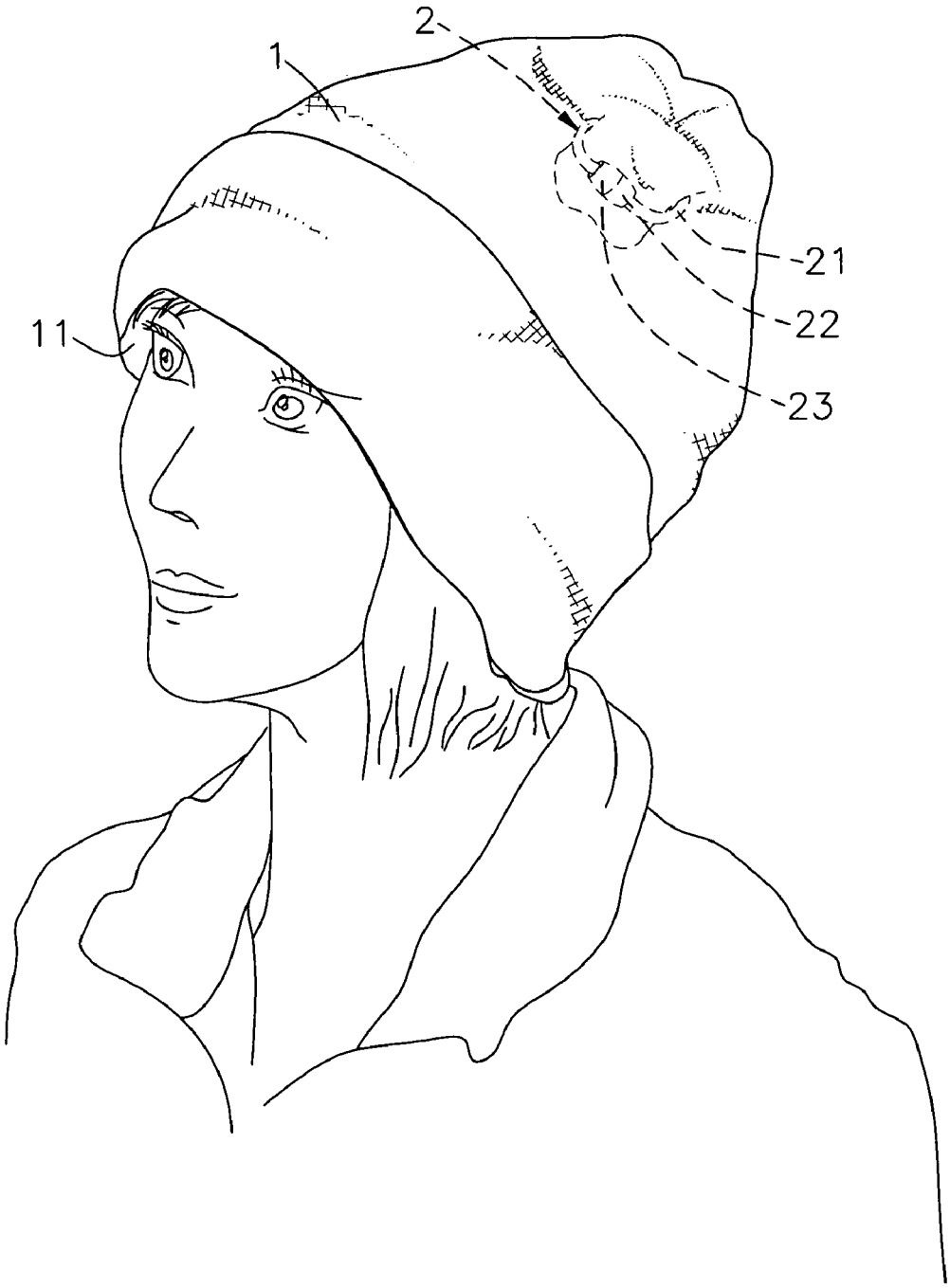
FIG. 8 shows still another application example of the dual-purpose neck gaiter according to the present invention.

FIG. 8 shows still another application example of the dual-purpose neck gaiter. This application example is similar to the application example shown in FIG. 7 with the exception that the gaiter body 1 is turned inside before putting on the user's head.

Figure 9:
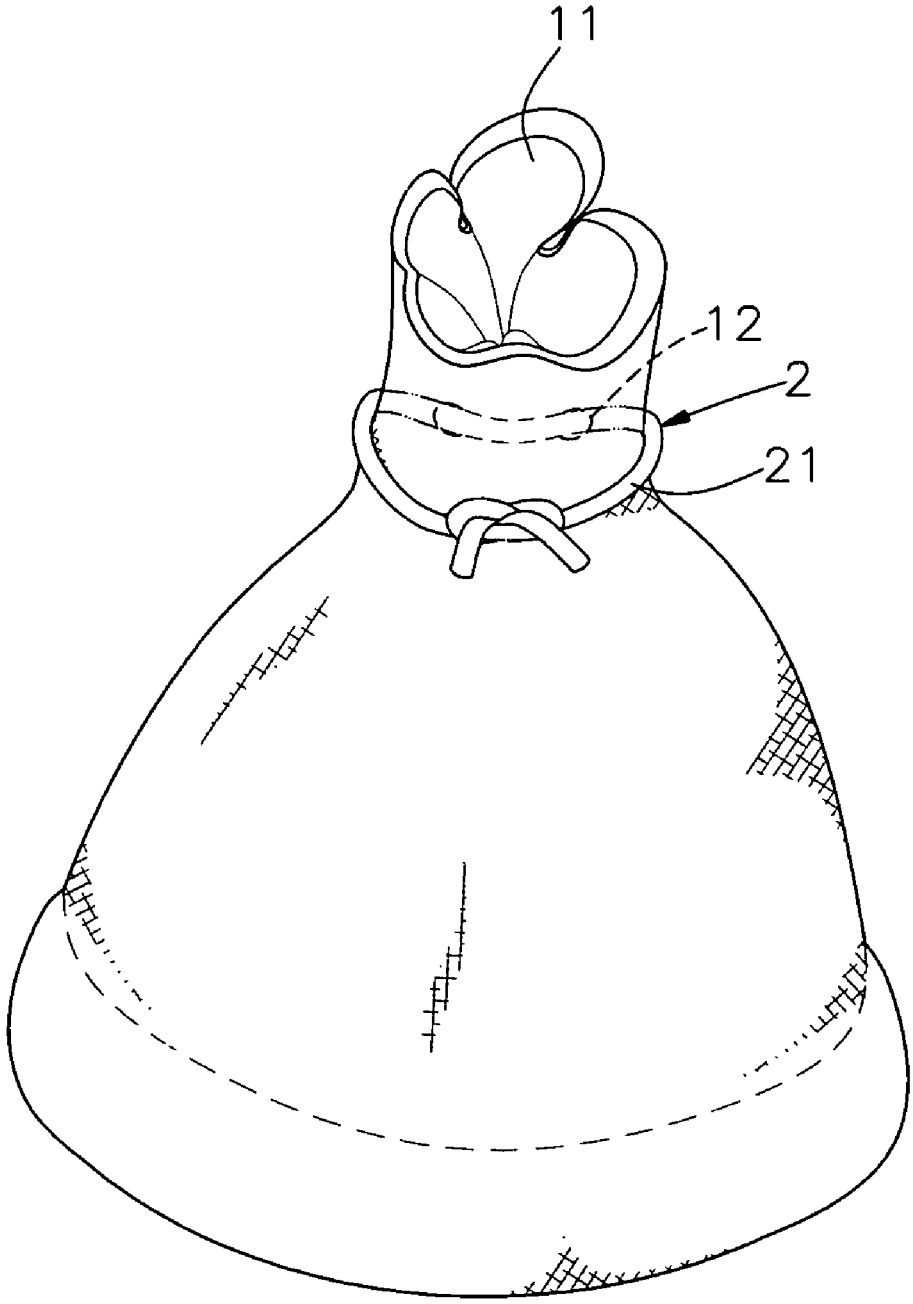
FIG. 9 shows another alternate form of the dual-purpose neck gaiter in accordance with the present invention.
Figure 10:
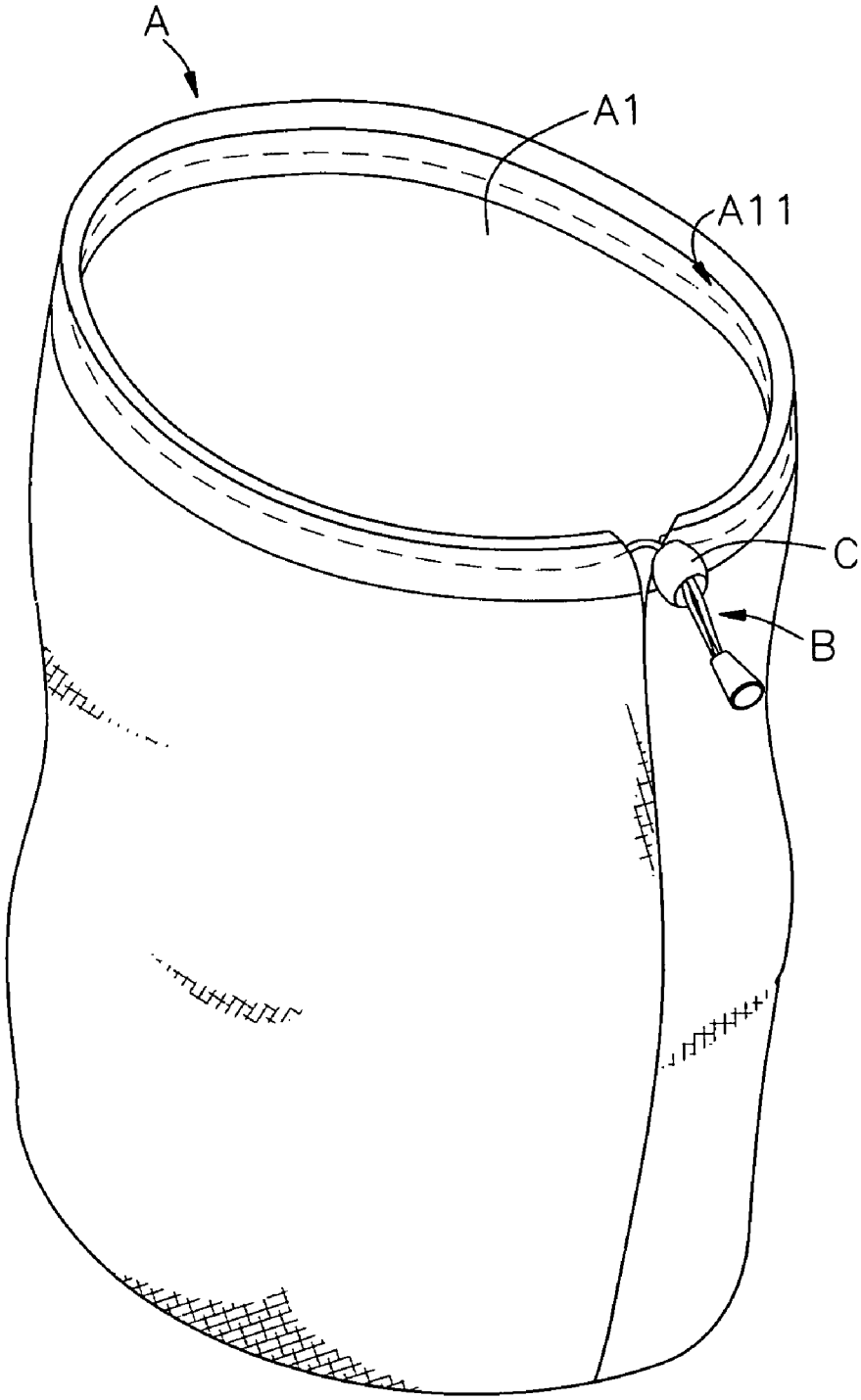
PRIOR ART FIG. 10
FIG. 10 is a schematic perspective view of a dual-purpose neck gaiter according to the prior art.
Figure 11:
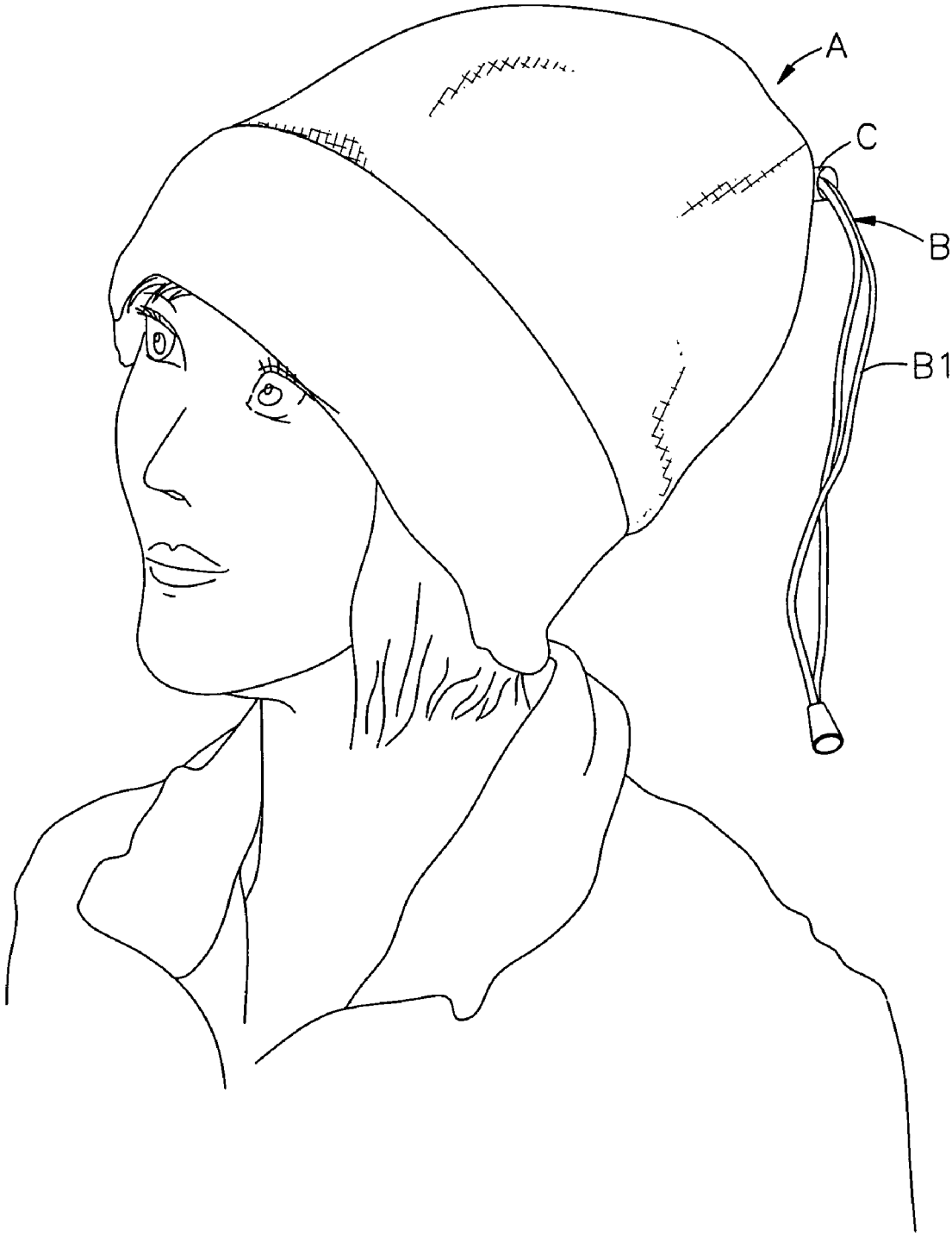
PRIOR ART FIG. 11
FIG. 11 is a schematic drawing, showing the prior art dual-purpose neck gaiter used as a beanie.

FIG. 9 shows another alternate form of the dual-purpose neck gaiter. This embodiment is substantially similar to the embodiment shown in FIG. 3 with the exception that the binder 2 is simply formed of an elastic cord member 21 without the aforesaid first connector 22 and second connector 23, and the two opposite ends of the elastic cord member 21 can be directly tied up.

Further, the gaiter body 1 and the binder 2 commonly have a simple structure and are easy and inexpensive to fabricate. Further, the elastic cord member 21 and the first connector 22 and second connector 23 can easily be operated to have the dual-purpose neck gaiter be set in one of many different forms for different applications. When in use, the component parts of the dual-purpose neck gaiter are kept from hooking the user's clothing or hair, or any external object while the gaiter body 1 keeping the user's neck or head warm.

In conclusion, the invention provides a simple structure of dual-purpose neck gaiter, which comprises a tubular gaiter body 1 that can be sleeved onto a person's neck or worn on person's head to keep the neck or head warm and has two insertion holes 12, and a binder 2, which comprises an elastic cord member 21 inserted through the insertion holes 12 and a first connector 22 and a second connector 23 respectively fastened to the two distal ends of the elastic cord member 21 for joining the ends of the elastic cord member 21 such that the binder 2 can bind up one end of the gaiter body 1 to have the dual-purpose neck gaiter be used as a beanie. Therefore, the dual-purpose neck gaiter is easy and inexpensive to manufacture for safe and comfortable use.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A neck gaiter, comprising:

a hollow cylindrical gaiter body, said hollow cylindrical gaiter body having two insertion holes transversely cut through the periphery thereof adjacent one of two openings thereof; and a binder, said binder comprising an elastic cord member inserted through said insertion holes of said hollow cylindrical gaiter body, a first connector fixed provided at one end of said elastic cord member, and a second connector fixedly provided at an opposite end of said cord member and detachably connectable to said first connector to join the ends of said elastic cord member, wherein a closed status of the opening adjacent to the insertion holes is defined by said elastic cord member being looped around an outer surface of said hollow cylindrical gaiter body adjacent the closed opening, and the opening adjacent to said insertion holes is opened by removing the looped elastic cord member from the hollow cylindrical gaiter body adjacent the closed opening and further inserting the elastic cord member through the insertion holes.

2. The neck gaiter as claimed in claim 1, wherein said gaiter body is formed of a warm-keeping and air permeable fabric.

3. The neck gaiter as claimed in claim 1, wherein said gaiter body comprises a fabric label, said fabric label having two distal ends stitched to said gaiter body near said insertion holes for holding a part of said elastic cord member.

4. The neck gaiter as claimed in claim 1, wherein said elastic cord member is a rubber cord member.

5. The neck gaiter as claimed in claim 1, wherein said elastic cord member is a plastic cord member.

6. The neck gaiter as claimed in claim 1, wherein said first connector is a male connector having a stub member, and said second connector is a female connector having a socket member connectable to said stub member.

7. A neck gaiter, comprising:

a hollow cylindrical gaiter body, said hollow cylindrical gaiter body having two insertion holes transversely cut through the periphery thereof adjacent one of two openings thereof; and an elastic cord member inserted through said insertion holes of said hollow cylindrical gaiter body for tying up one end of said hollow cylindrical gaiter body for enabling the neck gaiter to be used as a beanie, wherein a closed status of the opening adjacent to the insertion holes is defined by said elastic cord member being looped around an outer surface of said hollow cylindrical gaiter body adjacent the closed opening, and the opening adjacent to said insertion holes is opened by removing the looped elastic cord member from the hollow cylindrical gaiter body adjacent the closed opening and further inserting the elastic cord member through the insertion holes.

8. The neck gaiter as claimed in claim 7, wherein said gaiter body is formed of a warm-keeping and air permeable fabric.

9. The neck gaiter as claimed in claim 7, wherein said gaiter body comprises a fabric label, said fabric label having two distal ends stitched to said gaiter body near said insertion holes for holding a part of said elastic cord member.

10. The neck gaiter as claimed in claim 7, wherein said elastic cord member is a rubber cord member.

11. The neck gaiter as claimed in claim 7, wherein said elastic cord member is a plastic cord member.

* * * * *